US007261213B2

(12) United States Patent
Strating et al.

(10) Patent No.: US 7,261,213 B2
(45) Date of Patent: Aug. 28, 2007

(54) CLOSET PARTITION SYSTEM

(75) Inventors: Michael J. Strating, Holland, MI (US); Thomas H. Sligh, Holland, MI (US); Joel P. Gilcrest, Holland, MI (US)

(73) Assignee: Bilco Products Acquisition, LLC, Zeeland, MI (US)

( * ) Notice: Subject to any disclaimer, the term of this patent is extended or adjusted under 35 U.S.C. 154(b) by 199 days.

(21) Appl. No.: 10/939,614

(22) Filed: Sep. 13, 2004

(65) Prior Publication Data

US 2006/0054577 A1 Mar. 16, 2006

(51) Int. Cl.
*A47F 5/08* (2006.01)

(52) U.S. Cl. ..... 211/87.01

(58) Field of Classification Search ..... 211/87.01, 211/94.01, 189, 90.01, 90.02, 187; 248/339; 312/245

See application file for complete search history.

(56) References Cited

U.S. PATENT DOCUMENTS

| | | | | |
|---|---|---|---|---|
| 3,532,317 A | | 10/1970 | Adler | |
| 4,018,167 A | | 4/1977 | Spangler | |
| 4,401,222 A | * | 8/1983 | Kulikowski et al. | 211/94.01 |
| 4,457,436 A | | 7/1984 | Kelley | |
| 4,779,830 A | | 10/1988 | Phelps | |
| 4,951,908 A | | 8/1990 | Kallio | |
| 5,050,832 A | * | 9/1991 | Lee et al. | 248/225.11 |
| 5,222,611 A | * | 6/1993 | Wood et al. | 211/94.01 |
| 5,819,958 A | | 10/1998 | Dement | |
| 5,921,411 A | * | 7/1999 | Merl | 211/90.01 |
| 5,964,438 A | | 10/1999 | Camilleri | |
| 2002/0104813 A1 | | 8/2002 | Routhier | |
| 2003/0192845 A1 | | 10/2003 | Lawson et al. | |

FOREIGN PATENT DOCUMENTS

| | | |
|---|---|---|
| JP | 5056818 A | 3/1993 |

* cited by examiner

*Primary Examiner*—Sarah Purol
(74) *Attorney, Agent, or Firm*—Price, Heneveld, Cooper, DeWitt & Litton, LLP

(57) ABSTRACT

A closet partition system includes a simplified arrangement that reduces the number of steps required for installation and eliminates difficult manipulations, whereby an individual may easily install a closet partition system without requiring assistance. The mounting rail and bracket provide stable support that prevents the possibility of accidental dislodgement of the bracket from the mounting rail. The mounting rail includes a vertical back for attachment to a wall, a horizontal ledge projecting from the back, and a hook having a first section extending horizontally from the back and a second section extending downwardly toward the ledge. The bracket includes an elongate notch extending downwardly from an upper edge of the bracket for receiving the second section of the hook. This arrangement provides a closet partition system that is easy to use, capable of providing very high load bearing capability, and facilitates repeated disassembly and reassembly without degradation of the components.

5 Claims, 3 Drawing Sheets

CLOSET PARTITION SYSTEM

FIELD OF THE INVENTION

This invention relates to closet partition systems, and more particularly to closet partition systems incorporating improved wall-mountable bracket support hardware.

BACKGROUND OF THE INVENTION

It is now well recognized that the typical closet having one or more hanging rods and one or more shelves supported above the rod or rods does not usually facilitate the most efficient use of the available storage space in the closet. In order to more effectively utilize closet space, various modular-type storage unit systems and closet partition systems have been developed. The preferred modular systems typically are comprised of a few basic components, such as mounting rails, vertical panels, horizontal shelves, hanging rods, and various mounting brackets, which allow the components to be assembled in a variety of different manners to facilitate rearrangement as the users needs change. It is desirable that the mounting brackets and other hardware used for assembling the components provide a strong, stable final assembly of the components, and are relatively simple to use to facilitate assembly and disassembly when reconfiguration of the system is desired.

U.S. Pat. No. 4,779,830 to Phelps discloses a shelf support system comprising a bracket member that is snapped into a channel having two inwardly-directed jaw portions at the free ends of U-arms. Each of the brackets comprises a generally triangular portion and a generally planar portion. The brackets also include attachment means which comprises a head portion, side recesses, and flanges. To mount the bracket on the channel member, one of the side recesses of the attachment means is placed over the lower jaw portion of the channel. The jaw portion is then used as a pivot for rotation of the bracket member. As the bracket member is rotated, the head portion of the attachment means is squeezed past the upper jaw portion of the channel to snap the bracket member into position on the channel member. During this operation, the jaw portions are forced apart and move together again as the upper jaw portion of the channel member enters one of the side recesses of the bracket member. Separation of the recesses of the attachment means is slightly greater than the unstressed separation of the jaw portions of the channel member, whereby the jaws are stressed and exert a tight frictional grip on the attachment means. A deficiency with the support system disclosed in the Phelps patent relates to the snap-together features of the system. While snap-together connections facilitate rapid assembly, typically without tools, and may also facilitate disassembly, resiliently deformable materials must be utilized for one or both of the connectors on the two components that are being connected together. As a practical matter, inexpensive, resiliently deformable materials may not provide adequate strength for closet partition systems bearing heavy loads.

U.S. Pat. No. 5,050,832 to Lee et al. discloses an adjustable mounting system for removably supporting modular storage units on a vertical wall. The system is comprised of at least two substantially identical C-shaped brackets and a wall channel. Each C-shaped bracket includes an outboard flange with a slot, and a screw hole which facilitates adjustable mounting of the bracket to a modular storage unit. The arrangement shown in the Lee et al. patent appears to utilize rigid steel brackets that may be designed to achieve high strength and support high loads. Further, because connection of the brackets to the wall channel does not involve a snap type connection, the brackets can be repeatedly attached and removed from the wall channel without becoming permanently deformed and without any loss of functional integrity. However, the brackets and supported cabinetry or the like may be easily moved upwardly by an inadvertently applied upward force to the cabinetry or other supported units, and could under certain circumstances become inadvertently dislodged. Thus, it would be desirable to achieve comparable ease of installation and disassembly, and load-bearing strength, while reducing the possibility of inadvertently dislodging the bracket from the wall channel.

U.S. Pat. No. 5,222,611 to Wood et al. discloses a wall-unit hanging system that includes a mounting rail and a bracket for securing and attaching a vertical panel. Inadvertent dislodgement of the bracket from the mounting rail is prevented by utilizing fasteners (e.g., threaded screws) to attach the bracket to both the vertical panel and the wall channel. However, this arrangement has the disadvantage of adding steps to the assembly process, as well as the disassembly process, and could prevent multiple reconfigurations due to damage to the mounting rail caused by repeatedly attaching the bracket to the mounting rail using fasteners.

U.S. Pat. No. 5,964,438 to Camilleri discloses a wall-mounted storage unit that includes a wall panel and a reversible mounting bracket attached to the vertical panel. The Camilleri system is similar to the Wood et al. wall unit hanging system, and suffers from the same disadvantages as the Wood et al. system.

U.S. Pat. No. 4,457,436 to Kelly discloses a J-shaped wall rail support system. This system requires use of a standoff attached to the lower backside of a modular unit supported by the bracket, and therefore is not particularly well suited for supporting vertical panels or partitions, and still exhibits a substantial potential for undesired dislodgement if an inadvertent upward force of sufficient magnitude is applied to a supported partition.

SUMMARY OF THE INVENTION

The closet partition systems of this invention include a simplified mounting rail and bracket arrangement that overcomes problems associated with, and improves upon, known arrangements for mounting vertical members, such as partitions, to a wall. In particular, the mounting rail and the bracket for the closet partition system of the invention reduces the number of steps required for installation as compared with other systems that provide high load bearing capability, and eliminates difficult manipulations, whereby an individual may easily install a closet partition system without requiring assistance from a second person. Further, the mounting rail and bracket are configured to provide stable support that prevents the possibility of accidental dislodgment of the bracket from the mounting rail.

In one aspect of the invention, the closet partition system includes a mounting rail and a bracket for connecting a vertical member, such as a partition, to the mounting rail. The mounting rail includes a vertical back for attachment to a wall, a horizontal ledge projecting from the back, and a hook including a first section extending horizontally from the back and a second section extending downwardly from an outwardly projecting end of the first section and toward the ledge. The bracket includes an elongate notch extending vertically downwardly from an upper edge of the bracket for receiving the second section of the hook. This arrangement facilitates design of a closet partition system that is very easy to use, which is capable of providing very high load bearing capability, and which facilitates repeated disassembly and reassembly without degradation of the components or the load bearing properties of the components.

These and other features, advantages and objects of the present invention will be further understood and appreciated by those skilled in the art by reference to the following specification, claims and appended drawings.

DETAILED DESCRIPTION OF PREFERRED EMBODIMENTS

Figure 1:
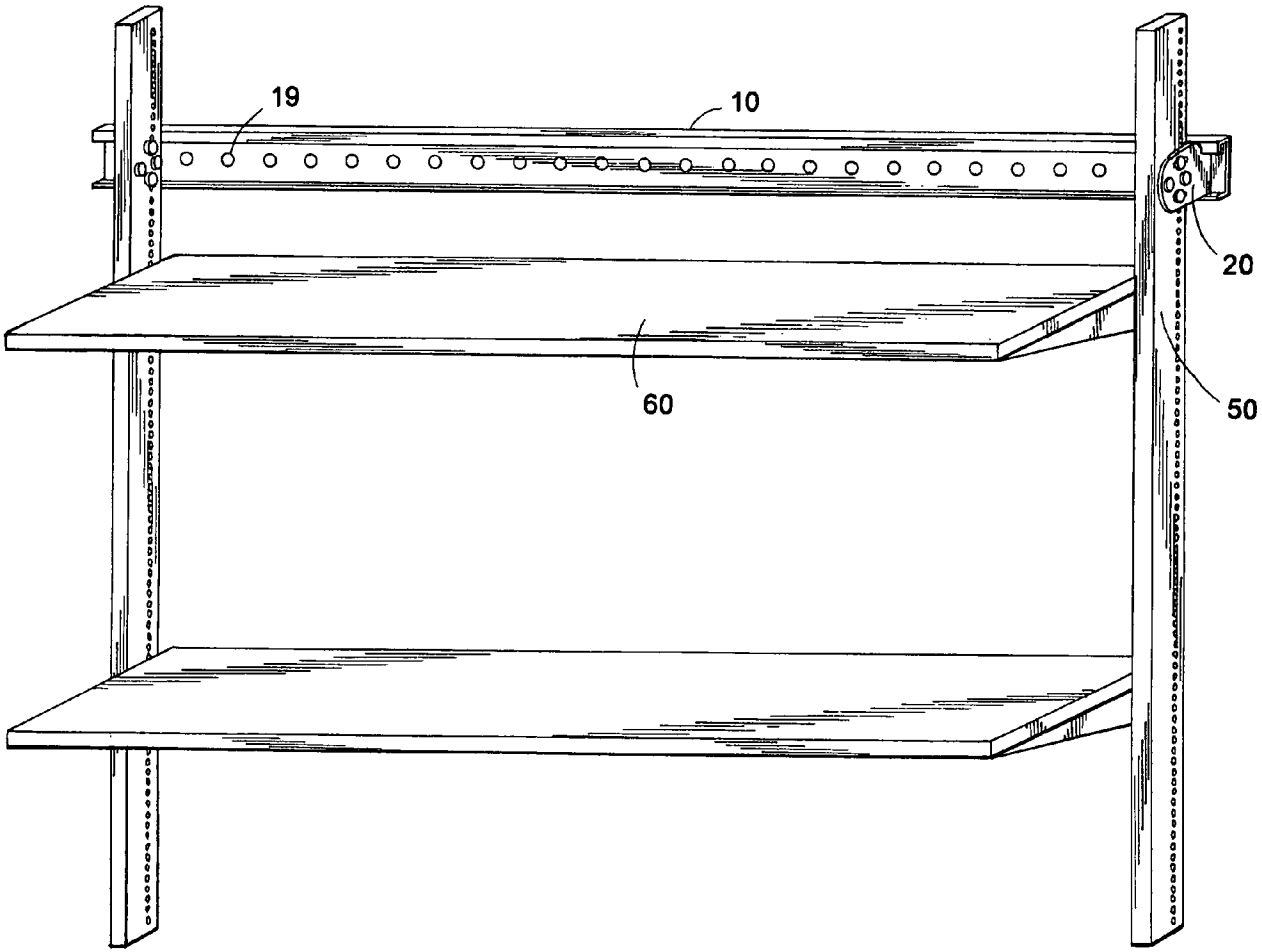
FIG. 1 is a perspective view of a closet partition system showing the components comprising an embodiment of the invention.
Figure 2:
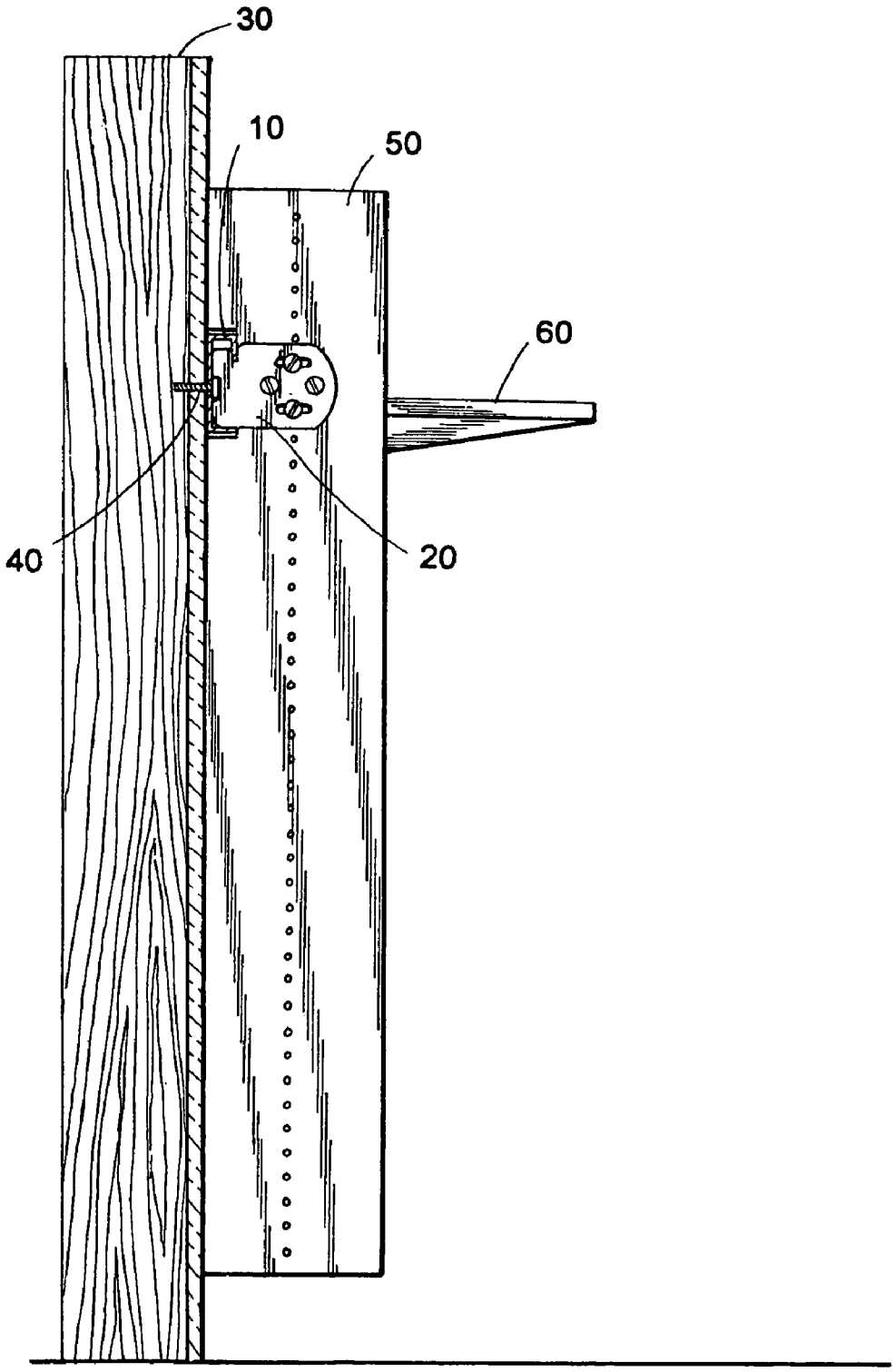
FIG. 2 is a vertical cross section of the closet partition system shown in FIG. 1.
Figure 3:
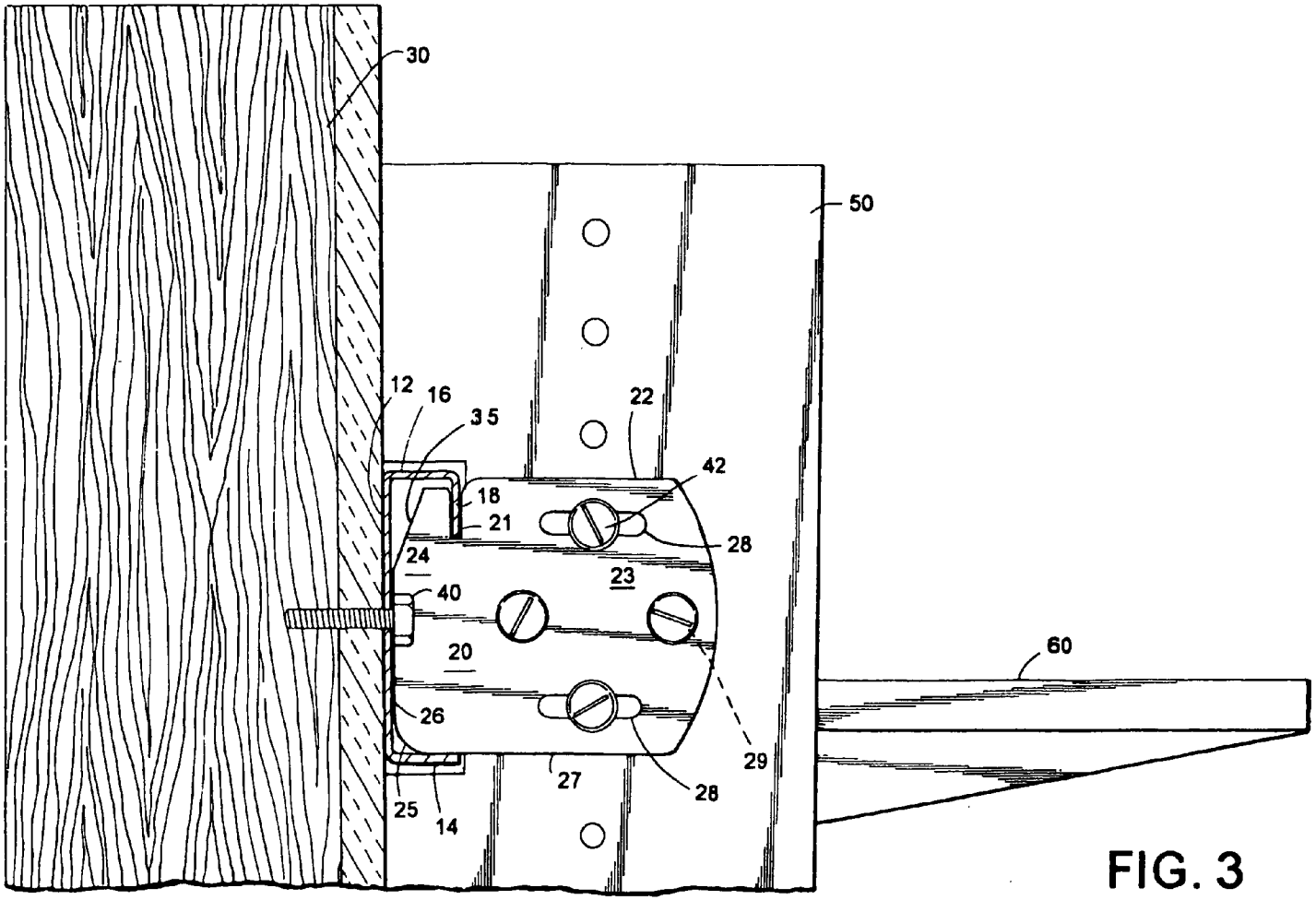
FIG. 3 is an enlarged cross-sectional view of the partition system shown in FIGS. 1 and 2, which shows features of the bracket and mounting rail in greater detail.

As shown in FIGS. 1–3, the closet partition system in accordance with this invention includes an interlocking wall mounting rail 10 and a bracket 20. Wall mounting rail 10 has a generally inverted J-shaped cross section, which includes a back section 12 for attachment of rail 10 to a wall 30, a lower horizontal ledge 14 projecting from a lower edge of back section 12 away from wall 30, and a hook having a first section 16 extending horizontally from an upper edge of back section 12 away from wall 30 and a second section 18 extending downwardly from the outwardly projecting end of first section 16 and toward ledge 14.

Mounting rail 10 may be fastened to wall 30 in generally any suitable manner that will provide adequate support for the components of the closet partition system which are suspended on rail 10. Mounting rail 10 can be provided with a plurality of apertures 19, which are uniformly spaced apart to facilitate attachment of rail 10 to wall 30 with threaded screws 40, nails or other mechanical fasteners.

Mounting rail 10 may, in some cases, be made of an extruded plastic material, such as when the load on rail 10 is relatively light. More preferably, in order to achieve high load bearing capability, at a relatively low cost, mounting rail 10 is made of an extruded metal, such as aluminum, or shaped metal sheet, such as steel. Steel is preferred because of its relatively low cost and relatively high strength to weight ratio.

Bracket 20 is designed to easily interlock with rail 10 to provide a strong connection between a supported partition and mounting rail 10, which cannot become easily dislodged from rail 10 by inadvertent upwardly directed forces. Bracket 20 includes an elongate notch 21, with the length of notch 21 extending vertically downwardly from an upper edge 22 of bracket 20. Notch 21 is adapted to tightly receive second downwardly extending section 18 of rail 10. Notch 21 divides bracket 20 into an outboard section 23 for attachment of a vertical member 50 and an inboard section 24 that is retained between back section 12, second section 18, ledge 14, and first section 16 of rail 10.

In accordance with certain embodiments of the invention, a corner 25 at the intersection between rail-facing edge 26 and lower edge 27 has a relatively high radius of curvature (i.e., is highly rounded) to facilitate ease of insertion of bracket 22 onto rail 10. Preferably, rounded corner 25 extends about 90 degrees (i.e., has approximately a quarter-circle shape) and has a radius of curvature about equal to half of the length that ledge 14 extends from back section 12 away from wall 30. A much larger radius of curative reduces the area of contact between lower edge 27 of bracket 20 and ledge 14, thereby reducing the area of support and increasing the possibility that bracket 20 could become dislodged from rail 10, and a lower radius of curvature reduces the ease of insertion of bracket 20 into rail 10. A preferred range for the radius of curvature is from about 25% to about 75% of the distance that ledge 14 extends away from back section 12.

Elongate apertures or slots 28 and circular aperture 29 extend through outboard section 23 of bracket 20 to facilitate attachment of a vertical member 50 to bracket 20 using threaded screws 42 or other suitable fasteners. While it is conceivable that a single slot 28 and/or a single circular aperture 29 may be used for supporting vertical member 50 on bracket 20, a plurality of slots 28 and/or circular apertures 29 are preferred in order to stably secure vertical member 50 on wall 30. In accordance with a preferred aspect of this invention, bracket 20 includes upper and lower elongate slots 28, and circular apertures 29 located generally between upper and lower slots 28 in order to facilitate easy installation. Specifically, this arrangement allows vertical member 50 to be loosely attached to bracket 20 during installation by using screws 42 for loosely connecting bracket 20 to vertical member 50. This is achieved by using two screws 42 that extend through upper and lower slots 28 partially into vertical member 50 in order to allow vertical member 50 to be moved relative to bracket 20 during installation. Specifically, vertical member 50 may be moved with respect to bracket 20 along the length direction of slots 28 during installation, and the planar faces of bracket 20 and vertical member 50 may be tilted with respect to each other slightly during installation to allow some independent movement of bracket 20 with respect to attached vertical member 50, further facilitating ease of installation. Bracket 20 cannot be easily secured on rail 10 unless bracket 20 is rotated around a horizontal axis normal (perpendicular) to the surface of wall 30. Thus, the ability to tilt bracket 20 slightly with respect to vertical member 50 during installation is particularly useful in those situations where rotation of vertical member 50 by the required amount is not possible or is awkward due to the length of the vertical member and/or interference with fixtures. To further facilitate insertion onto and removal of bracket 20 from rail 10, the upper portion of inboard section 24 of bracket 20 may be tapered so that bracket 20 can be first tilted around a horizontal axis approximately perpendicular to wall 30, then tilted around an axis approximately perpendicular to the plane of bracket 20 so that tapered edge 35 moves toward the back of rail 12 (i.e., toward wall 30) and corner 25 moves away rail 12. Tapered edge 35 may be straight or slightly curved. After bracket 20 and vertical member 50 have been properly positioned on rail 10, screws 42 extending through slots 28 are tightened and screws 42 are inserted through circular apertures 29 to secure and stabilize vertical member 50 against movement with respect to bracket 20.

Although bracket 20 can be made of various materials, including thermoplastic, thermoset or composite materials, bracket 28 is preferably made of a metal, such as steel, which provides high strength at a low cost. Preferably, both rail 10 and bracket 20 were fabricated from rigid materials that are sufficiently thick so that they do not exhibit resilient deformability characteristics.

The mounting rail 10 and brackets 20 of this invention may be used for supporting various vertical members, including vertical partitions, cabinet sidewalls, etc.

As shown in FIG. 1, a closet partition system may be completed by mounting shelves 60 between adjacent vertical partitions 50. This may be accomplished using conventional shelf mounting means.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A closet partition system comprising:

a mounting rail having a vertical back for attachment to a wall, a horizontal ledge projecting from the back, and a hook including a first section extending horizontally from the back and a second section extending downwardly from an outwardly projecting end of the first section and toward the ledge; and a bracket for connecting a vertical member to the mounting rail, the bracket having an elongate notch extending vertically downwardly from an upper edge of the bracket for receiving the second section of the hook and wherein the bracket includes a rail facing edge and a lower edge, and has a rounded corner at the intersection between the rail facing edge and the lower edge, the rounded corner having a radius of curvature of from about 25% to about 75% of the distance that the ledge extends from the back section of the mounting rail.

2. The closet partition system of claim 1, wherein the mounting rail is a steel rail.

3. The closet partition system of claim 1, wherein the bracket is a steel bracket.

4. The closet partition system of claim 1, wherein the bracket includes two elongate apertures for receiving fasteners for attaching a vertical member to the bracket, and a circular aperture for receiving a fastener to stabilize the vertical member against movement relative to the bracket.

5. The closet partition system of claim 1, wherein a tapered tab is defined between the elongate notch and an edge of the bracket.

* * * * *